US005544516A

United States Patent [19]

Robolini et al.

[11] Patent Number: 5,544,516

[45] Date of Patent: Aug. 13, 1996

[54] SYSTEM TO ROLL AT LEAST TWO SECTIONS IN BLOCKS OF FAST ROLLING MILL STANDS

[75] Inventors: Severo Robolini, Torbole Casaglio; Claudio Picotti, Gorizia, both of Italy

[73] Assignee: Danieli & C. Officine Meccaniche SpA, Buttrio, Italy

[21] Appl. No.: 274,982

[22] Filed: Jul. 13, 1994

[30] Foreign Application Priority Data

Jul. 13, 1993 [IT] Italy ..... UD93A0136

[51] Int. Cl.[6] ..... B21B 39/16

[52] U.S. Cl. ..... 72/235; 72/250

[58] Field of Search ..... 72/203, 204, 234, 72/235, 250, 365.2, 366.2

[56] References Cited

U.S. PATENT DOCUMENTS

| | | | |
|---|---|---|---|
| 3,742,751 | 7/1973 | Kozhevnikov et al. | 72/214 |
| 3,818,744 | 6/1974 | Sayer | 72/250 |
| 4,357,819 | 11/1982 | Elley | 72/204 |
| 5,174,142 | 12/1992 | Pong | 72/204 |

FOREIGN PATENT DOCUMENTS

| | | |
|---|---|---|
| 439666 | 7/1991 | European Pat. Off. . |
| 1220372 | 7/1966 | Germany . |
| 54-051953 | 4/1979 | Japan . |

OTHER PUBLICATIONS

Danieli Company Brochure, May 1986, Buttrio–Italy, pp. 1–8; BGV Wirerod Fast Finishing Blocks *pp. 3, 6.

Patent Abstract of Japan, vol. 9, No. 172 (M–397) 17 Jul. 1985 JPA–60–044 107 (Sakai Jukogyo) 9 Mar. 1985—Abstract.

*Primary Examiner*—Lowell A. Larson

*Assistant Examiner*—Thomas C. Schoeffler

*Attorney, Agent, or Firm*—Antonelli, Terry, Stout & Kraus

[57] ABSTRACT

System to roll at least two sections (13) in blocks of fast rolling mill stands, each fast rolling mill stand (11–12) including one pair of rolling rolls (17) supported as cantilevers and having alternately a horizontal axis (17*o*)/vertical axis (17*v*) or viceversa, the system comprising, in cooperation with the respective pairs of rolling rolls (17) of the block of fast rolling mill stands (11–12), a first guide box (15) for round sections which is positioned upstream of the first pair (11) of rolling rolls (17*v*), a second guide box (20) which receives oval sections and displaces at least partly at least two sections (13) from the rolling plane of the first pair of rolling rolls (17*v*) to a plane perpendicular to that rolling plane, a third guide box (24) with rolls which receives oval sections and aligns the same on the rolling plane of the second pair of rolling rolls (17*o*) and a fourth guide box (23) which receives round sections and displaces the sections (13) at least partly from the rolling plane of the second pair of rolling rolls (17*o*) to a plane perpendicular to that rolling plane, the fourth guide box (23) being followed by a fifth box which aligns the round sections on the rolling plane of the third pair of rolling rolls (17*v*), and so on in this sequence for the other pairs of rolling rolls (17*v*–17*o*), the second, third and fourth guide boxes (20-24-23) displacing the sections (13*a*–13*b*) without changing the circumferential position of the axes of the sections in relation to the horizontal.

14 Claims, 4 Drawing Sheets

SYSTEM TO ROLL AT LEAST TWO SECTIONS IN BLOCKS OF FAST ROLLING MILL STANDS

BACKGROUND OF THE INVENTION

This invention concerns a system to roll at least two sections in blocks of fast rolling mill stands.

The blocks of fast rolling mill stands according to the invention in a rolling plant are located downstream of a train of conventional rolling mill stands and upstream of a cooling line comprising a cooling plate.

The invention is applied to the situation where rolled products sheared to size are obtained on the cooling plate.

The rolling mill stands with which the invention is concerned are called commercially "blocks of fast rolling mill stands" and consist typically of a plurality of alternate pairs of rolls positioned as cantilevers with their axes rotated by ninety degrees to the next pair so as to process, for instance, oval sections followed by round sections followed by oval sections followed by round sections and so on.

These fast rolling mill stands can roll at 60 to 80 meters per second or more up to 120 to 140 meters per second.

In the blocks of fast rolling mill stands with which the invention is concerned the distance between the centre of one pair of rolling rolls and the centre of the next pair of rolling rolls is generally between 600 to 1200 millimeters.

It is known that the rolled product leaving the fast rolling mill stands undergoes an in-line cooling process carried out by feeding the rolled product into a cooling station consisting of cooling plates after the rolled product has been sheared to size.

It is also known that the maximum speed which can be reached in the entry channel of a cooling plate is about 20 to 30 meters per second in the double channels but more usually 12 to 20 meters per second in the roller conveyors owing to reasons linked to the handling and discharge of the bars of rolled stock.

Owing to the above the advantages connected to the use of these blocks of fast rolling mill stands are therefore substantially lessened, because also of the fact that these blocks of the state of the art can be employed only to roll one profile at a time.

The state of the art includes the so-called "splitting process" to increase the speed of processing of the rolled stock, this process consisting in processing at the same time two or more sections obtained by splitting a double initial rolled product.

In the state of the art this process has never been employed in fast rolling mill stand blocks owing to the difficulties linked to the rotation of the rolling plane from the horizontal to the vertical where there are successive pairs of rolls, close together as in this case, with alternate horizontal/vertical axes.

In fact, in passing from a module having a vertical axis to a module having a horizontal axis it is necessary to bring the two sections from a position superimposed on each other in a vertical plane to a position side by side on a horizontal plane while keeping constant the axial positioning of the single sections in relation to the horizontal.

Another problem encountered in employing these blocks of fast rolling mill stands in methods of rolling two sections relates to the bending of the axis of the cantilever rolls during the rolling step.

In fact, these cantilever rolls in blocks of fast rolling mill stands have a diameter of a rather small size of about 160 to 250 millimeters and are borne on shafts of a consequently very small diameter.

The problem of the bending of the shafts and of the geometric alteration of the reciprocal positions of the rolls when one single section is being rolled is important but can now be deemed to have been overcome in the state of the art.

But a problem which has still not been overcome is the simultaneous rolling of two substantially equal sections arranged side by side inasmuch as, if the distance between center of the two sections exceeds a given minimum value, a bending of the rolls takes place which changes substantially the geometric working conditions as between one section and the other.

Yet another unsolved problem, as we said, concerns the rotation of the plane of positioning of the two sections in the limited space between one pair of rolls and the next pair.

Still another problem is the lead-in equipment which guides the sections into the inlet of a pair of rolls and which requires minimum safety dimensions so as not to become worn and break quickly.

SUMMARY OF THE INVENTION

The present applicants have designed, tested and embodied this invention so as to enable blocks of fast rolling mill stands to be used also in a process of rolling two or more sections and to achieve further advantages.

The purpose of the invention is to make possible the simultaneous rolling of at least two sections in blocks of fast rolling mill stands with cantilever rolling rolls of a type having alternate horizontal/vertical axes and a pitch between 600 and 1200 mm. between one pair of rolling rolls and the next pair.

Another purpose of the invention is to keep the sections as close to each other as possible so as to reduce to a minimum the effect due to geometric bending of the reciprocal positions between the rolls.

In blocks of fast rolling mill stands having alternate axes the sections leaving the first module with an oval conformation, for instance with a vertical axis and with a greater axis lying substantially on a vertical plane, have to be displaced by 90° before the lead-in of the second module having a horizontal axis, while keeping constant the position of the axes of those sections in relation to the horizontal.

In this way alone can the second pair of rolls having a horizontal axis act on the oval products and produce at its outlet two sections having a substantially round cross-section.

The resulting problem which arises in this type of structure is how to provide a suitable guide equipment in view of the extremely limited spaces between one pair of cantilever rolls and the next pair and between one section and the neighbouring section.

The problem to be tackled is especially important in the lead-in portion of the pairs of cantilever rolls.

So as to simplify the description that follows, let us assume that the first module has a vertical axis while the second module has a horizontal axis, and so on, but the working principle of the invention is the same even if the situation is inverted.

According to the invention guide boxes are included between each fast rolling mill stand and the next one; these guide boxes are pre-arranged to act on the pair of sections so as to displace the sections from a position with one section above the other to a position with one section alongside the other without thereby generating a twist in the sections.

The two sections, which upon entry into the guide box located downstream of the first rolling mill stand are oval with their respective greater axes aligned vertically in this case, are displaced in relation to each other along the guide box with their axial position kept stationary in relation to the horizontal until they are brought to positions side by side on a horizontal plane.

The guide boxes have at their ends, in correspondence with the lead-in of the rolling rolls, feed-in bearings conformed so as to guide the sections until the latter are very near their point of contact with the rolling rolls.

The guide channels of the guide boxes are conformed so as to act on the periphery of the sections at the points of that periphery which are least subject to dimensional variations caused by the rolling process.

In other words the sections are guided along the surfaces on the periphery of the sections which are dimensionally "safe" surfaces so as to achieve the best possible guiding and to avoid errors due to surface deformations of the section being fed forwards.

The guide channels are associated with resilient adaptation means, which have the purpose of enabling the material to issue forth freely in the event of being jammed.

Moreover, these resilient adaptation means compensate any dimensional tolerances within a given field.

The guide channels are associated also with rigid adjustment means so as to pre-set the dimension of the gap of the guide channels.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
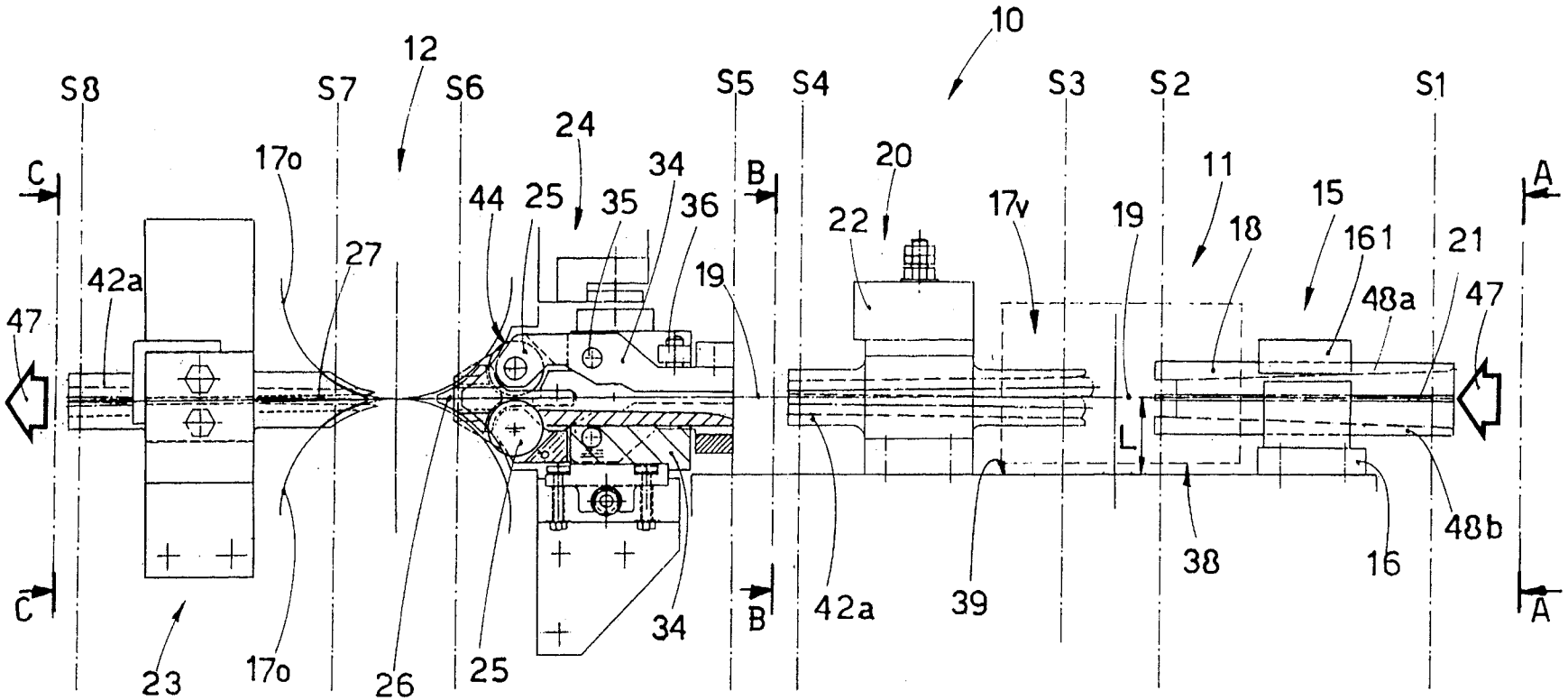
FIG. 1 is a side view of part of a section of a rolling plant employing a block of fast rolling mill stands comprising a module with rolls having a vertical axis and a module with rolls having a horizontal axis.

A rolling plant 10 with fast rolling mill stands is downstream of a conventional splitting unit, which is not shown here but slits a double rolled product into at least two sections, referenced with 13*a* and 13*b*, which are delivered to the plant 10 with fast rolling mill stands.

We shall deal here with the case of two sections 13*a*–13*b*, but the invention is applied also to simultaneous rolling of three sections.

In this latter case the central section is kept lying substantially on the rolling axis during its whole passage through the plant 10, whereas the outer sections arc displaced at the outlet of each rolling mill stand from the plane of positioning of the axes of the rolls of the preceding rolling mill stand to the plane of positioning of the axes of the rolls of the successive rolling mill stand.

The plant 10 with fast rolling mill stands consists of an alternate plurality of rolling mill stands 11 having a vertical axis and rolling mill stands 12 having a horizontal axis.

The overall number of rolling mill stands 11–12 included in a typical plant 10 of fast rolling mill stands is generally from two to ten. Each fast rolling mill stand 11–12 consists of a pair of rolling rolls 17 installed as cantilevers.

The substantially round sections 13*a*–13*b* produced by the splitting unit are sent in the direction of feed 47 to the plant 10 through a first guide box 15 for round products.

The two round sections 13*a*–13*b* are fed superimposed on each other, thus defining a vertical plane 32 substantially in the middle between the rolling rolls 17*v* of all the rolling mill stands having a vertical axis 11 and a horizontal plane 33 substantially in the middle between the rolling rolls 17*o* of all the rolling mill stands having a horizontal axis 12. The vertical plane 32 is perpendicular to the horizontal plane 33.

The intersection of the vertical plane 32 with the horizontal plane 33 defines the rolling axis 19 of the plant 10.

Figure 3:
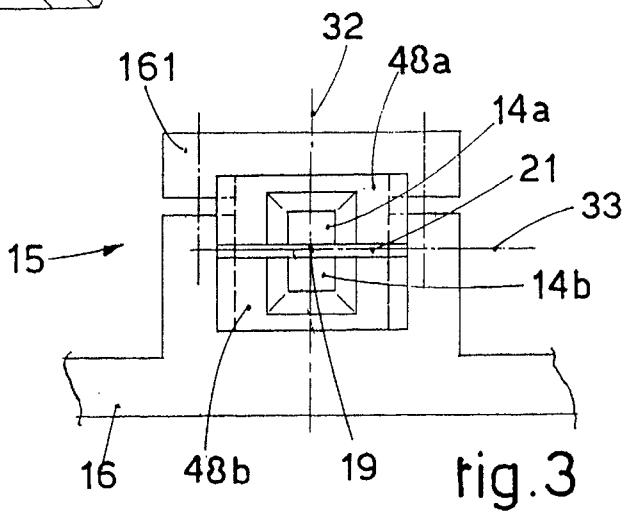
FIG. 3 is a view in an enlarged scale along the line A—A of FIG. 1.
Figure 5:
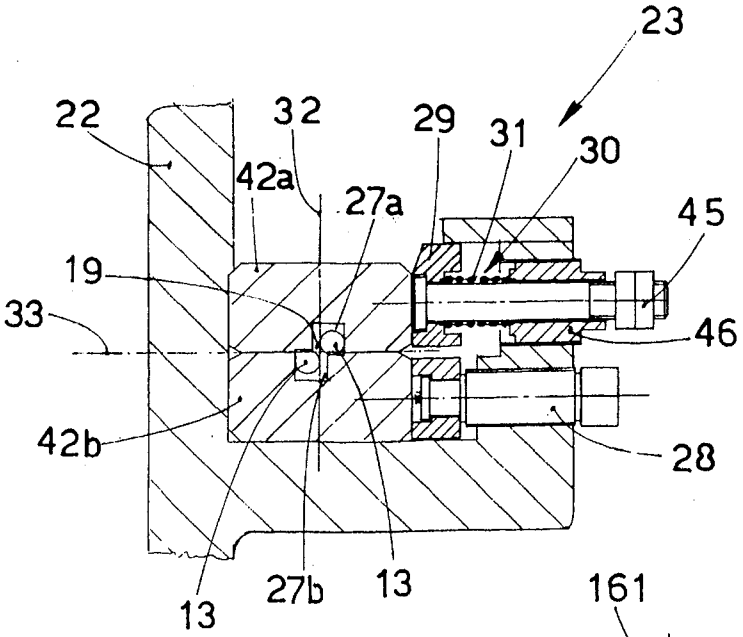
FIG. 5 is a view in an enlarged scale along the line C—C of FIG. 1.

A first guide box 15 is fitted to a support 16 with a cover 161 of a known type and comprises in this case two guide channels 14*a* and 14*b* which are substantially counterparts in relation to the horizontal plane 33 (see FIG. 3).

The guide channels 14*a*–14*b* are defined by two equal half-guides 48*a* and 48*b* installed as counterparts to each other with a separator 21 in an intermediate position. The half-guides 48*a*–48*b* are shaped terminally with a lead-in flared connection 18 so as to guide the sections 13 to the vicinity of the point of contact between the sections 13 and the rolling rolls 17*v* of the first fast rolling mill stand 11 having a vertical axis (v).

Figure 9:
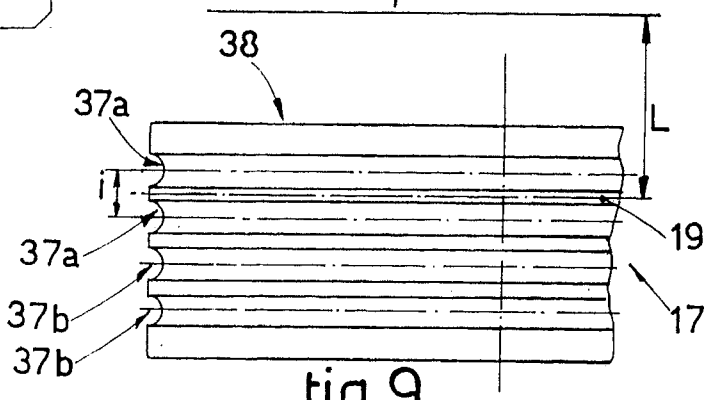
FIG. 9 shows a segment of a cantilever rolling roll as embodied in one form of the invention.

The rolling rolls 17, whether horizontal 17*o* or vertical 17*v*, include shaped portions 37 consistent with the dimensions and position of feed of the sections 13 (FIG. 9). In this example the rolling rolls 17 (FIG. 9) contain a number of shaped portions 37 which is twice the number of sections 13 being processed.

In particular, the shaped portions 37*a* positioned at the part of the edge 38 of the rolling rolls 17 associated with the frontal plane 39 of the rolling plant 10 represent the working channels, whereas the auxiliary shaped portions 37*b* represent the inactive channels; the auxiliary shaped portions 37*b* are positioned as counterparts to the working shaped portions 37*a*.

This configuration makes possible the rotation of the rolling rolls 17 by 180° for instance after a given period of work or particularly heavy wear of the working shaped portions 37*a*, thus inverting the working/inactive condition of the shaped portions 37*a*/37*b* and increasing the working life of the rolling rolls 17.

The edge 38 of the rolling rolls 17 is located in this case at a distance between 40 and 60 mm. from the relative frontal plane 39 of the plant.

In this example (FIG. 9) the rolling axis 19 intermediate between the two working shaped portions 37*a* and therefore between the two sections 13 is positioned at a distance "L" between 60 and 80 mm. from the relative frontal plane 39 of the plant and with a pitch "i" of 12 to 20 mm. between the two sections 13.

The two sections 13 (S2 at the inlet) are rolled by the rolling rolls 17*v* of the fast rolling mill stand having a vertical axis 11 so as to produce two outgoing substantially oval sections 13 (S3) with their respective greater axes lying substantially on the vertical plane 32. The outgoing sections 13 (S3) are guided into a second guide box 20, which is equipped to receive the oval sections 13 (S3) and to carry out an at least partial displacement of those oval sections (S4) from the vertical rolling plane 32 of the first vertical rolls 17*v* towards the horizontal rolling plane 33 of the first horizontal rolls 17*o* of the first rolling mill stand 12 having a horizontal axis.

Figure 4:
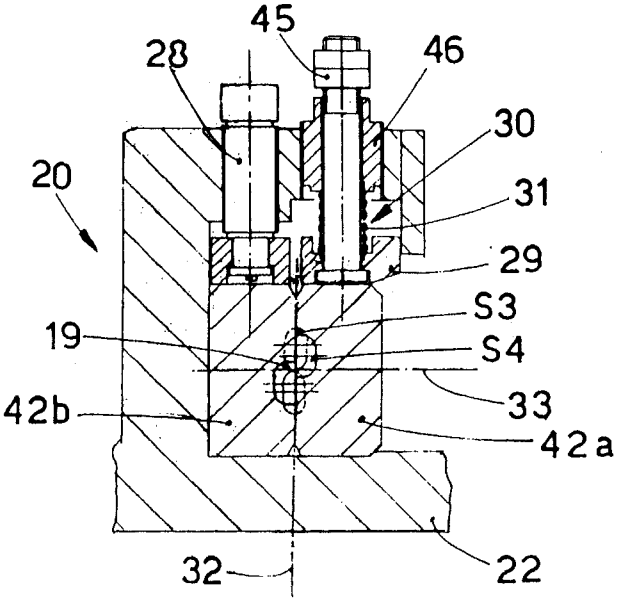
FIG. 4 is a view in an enlarged scale along the line B—B of FIG. 1.

The second guide box 20 consists of a first outlet guide 42*a* cooperating with a second outlet guide 42*b*; the first and second outlet guides 42*a*–42*b* are suitable to guide the outgoing oval sections 13 (S3) and to displace them towards the horizontal plane 33 (S4) and are fitted to a support 22 (FIG. 4).

With reference to FIG. 4 the positions of entry (S3) of the two sections 13*a*–13*b* into the second guide box 20 are shown with lines of dashes (S3), whereas their outgoing positions are shown with continuous lines (S4).

Figure 6:
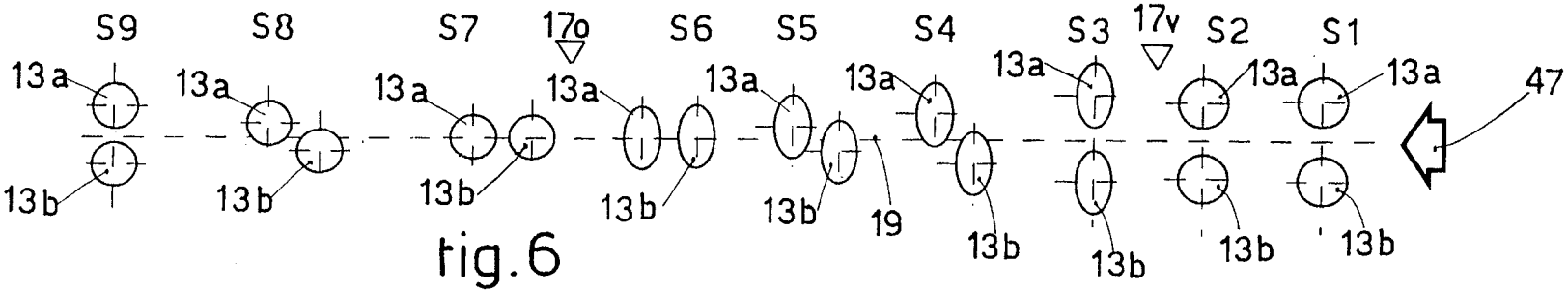
FIG. 6 shows the relative positions of the sections in the various segments of the plant of FIG. 1.

The sections 13 leaving the second guide box 20 are delivered into a third guide box 24 with rolls, which receives the oval sections (S5) and delivers them to the rolling rolls 17*o* at position S6 (FIG. 6).

This third guide box 24 with rolls is suitable to insert the oval sections at position S6 between the rolling rolls 17*o* of the next fast rolling mill stand 12 with horizontal axes.

The third guide box 24 with rolls completes the vertical displacement of the sections 13 and aligns them on the substantially horizontal plane 33 within guide rolls 25 located in the vicinity of the horizontal rolling rolls 17*o* of the next fast rolling mill stand 12 with horizontal axes.

The guide rolls 25 in the third guide box 24 with rolls are supported on levers 34 pivoted on a pivot 35 and comprise circumferential shaped portions 44 consistent with the sections S6.

The levers 34 cooperate with screw adjustment means 36 in setting and determining the reciprocal distance between the guide rolls 25.

Figure 8:
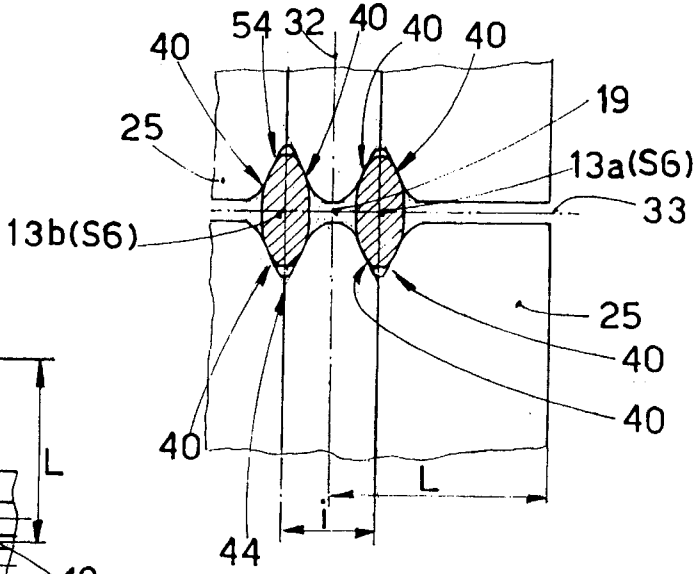
FIG. 8 is a possible inlet segment of a module with rolls having a horizontal axis.

The circumferential shaped portions 44 of the guide rolls 25 and also the guide channels of the first, second and fourth guide boxes 15-20-23 are embodied in such a way as to act on the periphery of the sections 13 at zones 40 of that periphery (FIG. 8). These zones 40 are dimensionally "safe" surfaces, namely surfaces which are least subject to the dimensional variations which occur in the rolling process.

Figure 2:
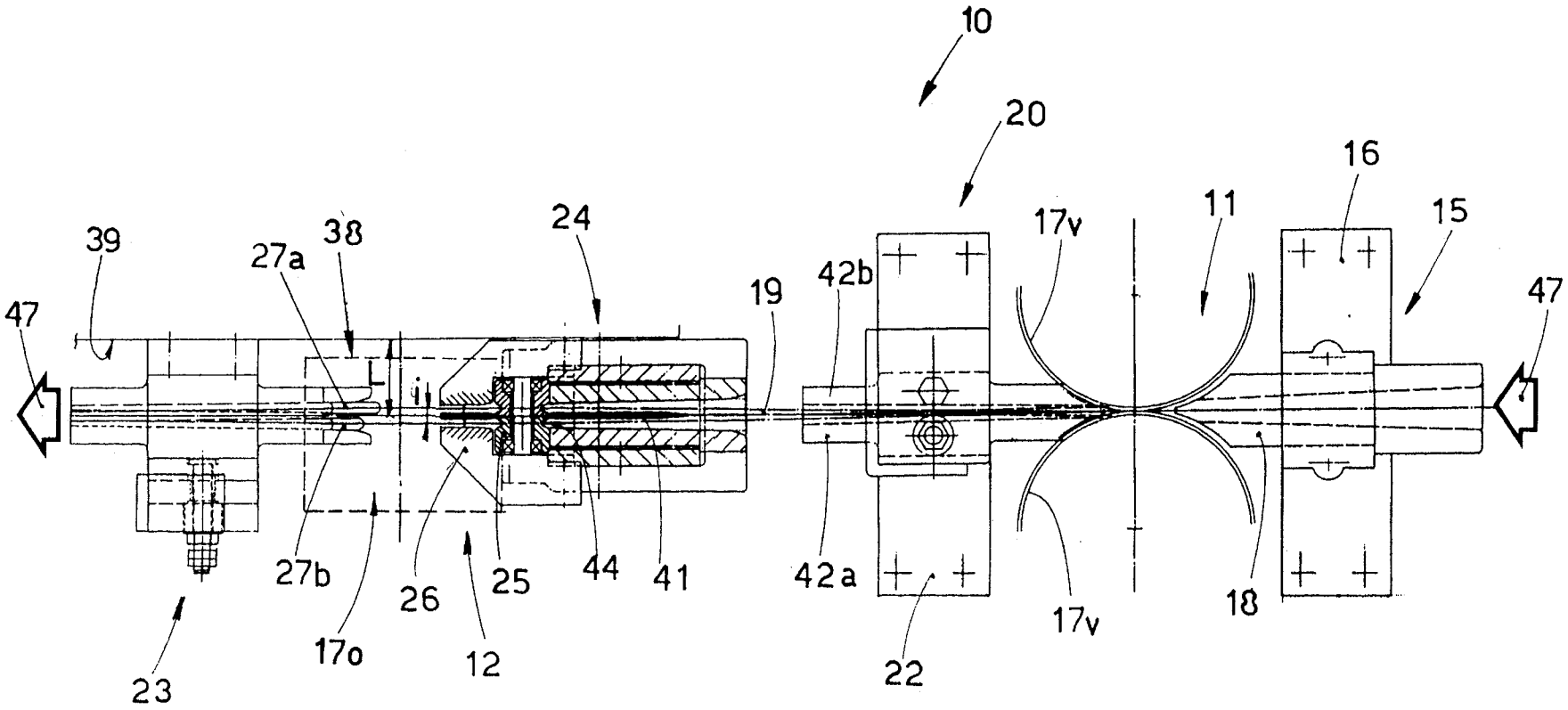
FIG. 2 is a plan view of the plant of FIG. 1.

The third guide box 24 includes, at least upstream of the guide rolls 25, a separator means 41 (FIG. 2) which has the purpose of positioning correctly the sections 13 and of assisting the entry of the sections 13 between the circumferential shaped portions 44 of the guide rolls 25.

The sections 13 at position S6 are guided by the guide rolls 25 towards an inlet bearing 26, which cooperates directly with the rolling rolls 17*o* of the fast rolling mill stand 12 having horizontal axes.

The fast rolling mill stand 12 with horizontal axes acts on the sections 13 (S6) placed side by side so as to produce substantially round outgoing sections S7, which are delivered into the guide channels 27*a*–27*b* of a fourth guide box 23.

The fourth guide box 23 too comprises outlet guides 42*a*–42*b* which are different from those of the second guide box only as regards the conformation of the guide channels 27*a* and 27*b*.

The fourth guide box 23 is arranged rotated by 90° in relation to the second guide box 20 so as to be adapted to the preceding rotation of 90° of the plane of positioning of the sections 13.

The second and fourth guide boxes 20–23, in relation to the first outlet guide 42*a*, comprise means for resilient absorption of the stresses applied by the sections 13 entering the relative guide channels 27.

The second outlet guide 42*b* is fitted so as to be stationary and discharges the stresses, arising from the passage of the sections 13, onto the support 22 of the second and fourth guide boxes 20 and 23 and is associated with screw clamping means 28.

The first outlet guide 42*a* is associated with pre-loaded resilient means 30, which absorb the displacement resiliently, permitting the first outlet guide 42*a* to be displaced by the section 13 in the event of any jamming.

The pre-loaded resilient means 30 comprise at least one spring 31 associated with a thrust block 29 and with an adjustable ring nut 46 on which an adjustment screw 45 acts.

The round sections 13 leaving the fourth guide box 23 are then guided towards the rolls 17*v* of a second rolling mill stand 11 having a vertical axis (not shown here) through a fifth guide box with rolls (not shown here), which has a structure and method of working analogous to those of the first guide box 15.

The round sections 13 are guided thence towards the successive rolling mill stands 11–12 by methods analogous to those described above until the rolling process has been completed.

Figure 7:
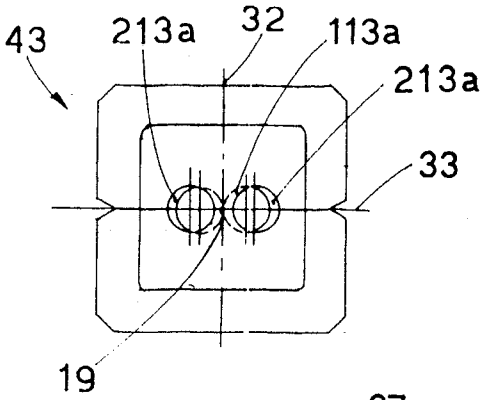
FIG. 7 shows a possible outlet segment of the last module with rolls having a horizontal axis.

FIG. 7 shows a separator assembly 43 located downstream of the last rolling mill stand. This separator assembly 43 no longer has the task of rotating the rolling plane of the sections 13 but is provided to distance the sections 13 from each other from their adjacent positions 113*a* shown with lines of dashes to their separated positions 213*a* shown with continuous lines so as to send the sections 13 separately to their respective downstream processing units.

FIG. 6 shows the sequence of the development of the reciprocal positions of the two sections 13*a*–13*b* at all the inlet and outlet portions of the respective first 15, second 20, third 24 and fourth 23 guide boxes, these portions being referenced with S1 to S8 in FIG. 1, whereas FIG. 6 includes also the reference S9 representing the inlet position into the next vertical rolling mill stand.

We claim:

1. System to roll at least two sections comprising a plurality of blocks of fast rolling mill stands arranged along a rolling axis, each fast rolling mill stand including one pair of rolling rolls supported as cantilevers, the respective fast rolling mill stands having alternately along said rolling axis rolling rolls having a horizontal axis and a vertical axis, the rolling rolls having a diameter between 160 and 250 mm. and a distance between 600 and 1200 mm. between the center of one pair and the center of the next pair of rolls, respective alternate rolling rolls defining a vertical plane substantially intermediate between the respective rolling rolls having a vertical axis and a horizontal plane substantially intermediate between the respective rolling rolls having a horizontal axis, the rolling axis being defined by an intersection of the vertical axis and the horizontal axis and being intermediate between the sections, the system further comprising, in cooperation with the respective pairs of rolling rolls of two blocks of fast rolling mill stands, a first guide box for round sections which is positioned upstream of a first pair of rolling rolls, a second guide box which receives oval sections and displaces at least partly at least two sections from a first rolling plane of the first pair of rolling rolls to a second plane perpendicular to the first rolling plane, a third guide box with rolls which receives oval sections and aligns the same on the second rolling plane of a second pair of rolling rolls and a fourth guide box which receives round sections and displaces the sections at least partly from the second rolling plane of the second pair of rolling rolls to the first plane perpendicular to the second plane, the fourth guide box being followed by a fifth box which aligns the round sections on the first plane, the second, third and fourth guide boxes displacing the sections without changing a circumferential position of axes of sections in relation to the horizontal.

2. System as in claim 1, in which the first, second, third and fourth guide boxes guide two sections at a time.

3. System as in claim 1, in which the first, second, third and fourth guide boxes guide three sections at a time, the central section lying substantially on the rolling axis.

4. System as in claim 1, in which the third guide box with rolls comprises guide rolls with circumferential shaped portions consistent with the sections, the guide rolls being positioned in a vicinity of the second pair of rolling rolls and cooperating with an inlet bearing, the guide rolls being supported by pivoted levers cooperating with means that adjust a reciprocal distance of the guide rolls.

5. System as in claim 4, in which the third guide box with rolls comprises, at least in a position upstream of the guide rolls, separator means cooperating with a gap between the circumferential shaped portions of the guide rolls.

6. System as in claim 4, in which the circumferential shaped portions cooperate with specific lateral surfaces of a periphery of single sections.

7. System as in claim 1, in which the second and fourth guide boxes include for each displace section an outlet guide, the outlet guides being substantially counterparts, at least one outlet guide being kept in position by resilient means.

8. System as in claim 1, in which the first guide box comprises two substantially counterpart half-guides separated by a separator so as to define guide channels.

9. System as in claim 1, in which each pair of rolling rolls is provided with shaped portions in a lateral edge of each rolling roll.

10. System as in claim 9, in which a distance between centres of the shaped portions of the rolling rolls defining the sections is between 12 and 20 mm.

11. System as in claim 9, in which further alternative shaped portions positioned as counterparts to the shaped portions of each pair of rolling rolls are included in a vicinity of an edge opposite the lateral edge of each rolling roll.

12. System as in claim 9, in which a distance (L) of the rolling axis from a frontal plane of a plant in which the system is installed is between 60 and 80 mm.

13. System as in claim 1, wherein a first of said fast rolling mill stands has rolling rolls having a vertical axis.

14. System as in claim 1, wherein a first of said fast rolling mill stands has rolling rolls having a horizontal axis.

* * * * *